US005808583A

United States Patent [19]

Roberts

[11] Patent Number: 5,808,583

[45] Date of Patent: Sep. 15, 1998

[54] SYSTEM FOR USING SUNSHINE AND SHADOWS TO LOCATE UNOBSTRUCTED SATELLITE RECEPTION SITES AND FOR ORIENTATION OF SIGNAL GATHERING DEVICES

[76] Inventor: James M. Roberts, 3915 Carnavon Way, Los Angeles, Calif. 90027

[21] Appl. No.: 405,267

[22] Filed: Mar. 13, 1995

[51] Int. Cl.[6] ..... H01Q 3/00

[52] U.S. Cl. ..... 342/359; 343/894

[58] Field of Search ..... 343/760, 894; 33/271, 273, 268, 1 T, 1 DD, 1 CC; 342/359

[56] References Cited

U.S. PATENT DOCUMENTS

| | | | |
|---|---|---|---|
| 2,904,889 | 9/1959 | France, II | 33/268 |
| 3,803,626 | 4/1974 | Garrett | 343/894 |
| 4,159,576 | 7/1979 | Campbell | 33/281 |
| 4,288,922 | 9/1981 | Lewis | 33/268 |
| 4,454,658 | 6/1984 | Lewis et al. | 33/268 |
| 4,888,592 | 12/1989 | Paik et al. | 342/359 |
| 4,956,920 | 9/1990 | Kutz | 33/268 |
| 5,276,972 | 1/1994 | Staney | 33/271 |

*Primary Examiner*—Gregory C. Issing
*Attorney, Agent, or Firm*—Fulwider Patton Lee & Utecht, LLP

[57] ABSTRACT

A new and improved system which facilitates the use of sunlight and sun shadows to optimize site surveys and the placement of satellite dish antennas and the like in order to provide unobstructive reception from a satellite transmitter and, further, facilitate alignment of the dish relative to a satellite.

6 Claims, 11 Drawing Sheets

SYSTEM FOR USING SUNSHINE AND SHADOWS TO LOCATE UNOBSTRUCTED SATELLITE RECEPTION SITES AND FOR ORIENTATION OF SIGNAL GATHERING DEVICES

BACKGROUND OF THE INVENTION

Field of the Invention

This invention relates generally to a new and improved method and apparatus for optimizing satellite dish site surveys, placement and alignment and, more particularly, to a new and improved method and apparatus of using sunshine and shadows for determining unobstructed satellite signal reception and subsequent dish alignment which is easy to use, reliable, accurate, versatile, economical and efficient.

In recent years, it has been common practice to use satellite systems for communications, video entertainment and the like. Geostationary satellites orbit the earth in such a way that their position in the sky appears to be constant. The satellite's position is conventionally defined by the two dimensions of: (1) azimuth (the angular number of degrees, measured in the local horizontal plane, eastward around from 0/360 as North}; and (2) elevation (the angular number of degrees, measured up from the local horizon). Signals from the satellites can be absorbed and/or deflected by physical obstructions in the straight line between the satellite and the potential reception sites. It is, therefore, necessary to choose sites for reception which are free from obstructions in the direction of the satellite.

For simplicity of communication, the term "dish" will be used to signify the full range of devices used to gather signals from the satellite transmitters: focally reflective surfaces commonly called "Dishes"; as well as collective funnels commonly called "Horns"; and, absorbative antenna commonly called "Yagii", "Flat Plates" or "Phased Arrays". Survey of acceptable site(s) for permanently located satellite reception dishes involves considerations of these devices being: visually/aesthetically unobtrusive; inaccessible to vandals and/or thieves; as well as the necessity shared with selection of parking or mooring sites for Recreational Vehicles carrying mobile Dishes, that the satellite dish must have a clear and unobstructed line of sight relative to the satellite transmitter in order to maximize the quality of signal reception, i.e., to maximize the received signal level and the signal to noise ratio. Failure to obtain unobstructed reception results in diminished picture and/or audio quality.

Currently, optimization of satellite dish placement to provide unobstructed reception from the satellite transmitter, requires a great deal of effort and skill on the part of a dish antenna installer in order to properly survey potential sites to select a site; and then to align the satellite dish relative to the satellite transmitter. This process includes the installer having to go to each site to be surveyed to look towards the azimuth and elevation direction of a selected satellite for obstructions. Accessing the sites is troublesome, particularly since desirable permanent sites, as noted above, may be intentionally inaccessible so as to thwart vandals and/or thieves. Looking in the direction of the satellite requires possession of, and skill in the use of, angle measuring tools (typically a compass for determination of azimuth, and an Inclinometer for determination of elevation). The satellites' positions are often separated by only one or two angular degrees, so that considerable accuracy is required of the tools. This required accuracy makes the tools expensive and fragile. Furthermore, compasses are troublesome to use because of their vulnerability to deflection toward any ferris metal in their proximity and because of the need to allow/compensate for local variations in the earth's magnetic field. Sometimes sunshine/shadows are employed at local noon, as an indication of True North/South. Subsequently, a compass or other horizontal angle measuring device is employed to determine the azimuth direction to the satellite.

In addition, it is important to acknowledge the relation of the sun's position to the satellites is the prediction of spring and fall occurrences when the sun is directly in line with the satellites. At those times, the sun's radiant energy temporarily interferes with reception of the satellite's transmissions. It is currently the practice to forewarn owners of satellite reception systems of those impending solar interference occurrences so that they will not be concerned that some fault has developed within their electronics. These limited, and only occasional, uses of knowledge and/or prediction of time and sun position, relative to the satellites, are the extent of current practice.

After the dish is placed in the selected site, it must be oriented toward the satellite transmitter. Again, this is accomplished using the currently accepted two dimensions of azimuth and elevation. Currently, the practice is to set the dish as close as possible to one of these dimensions and then to move it through the other dimension in search of the satellite's signal. In view of the trouble using compasses, most installers initially set the elevation dimension by measuring the slope of the dish, or by setting the elevation of the dish based upon marks on the dish support. Next, the installer must sweep the dish along a wide range of azimuths to find the selected satellite. In addition, the use of electronic instrumentation is required in order to make the necessary adjustments to the dish antenna in order to maximize its effectiveness. Furthermore, using this prior art method requires efforts to make sure that the dish support is plumb, otherwise the marks on the dish support can be misleading and/or the elevation will vary as the dish is moved through a range of azimuths.

Accordingly, those concerned with the site selection and the optimization of dish antenna placement have long recognized the need for improvements in methods for optimizing dish placement relative to a satellite transmitter which are easy to use, accurate, reliable, versatile, economical and efficient. The present invention clearly fulfills all these needs.

SUMMARY OF THE INVENTION

Briefly, and in general terms, the present invention provides a new and improved system which facilitates the use of sunlight and sun shadows to optimize site surveys and the placement of satellite dish antennas in order to provide unobstructed reception from a satellite transmitter and as a guide in orienting the dish to both the azimuth and elevation of the satellite. Furthermore, this method is easy to use, reliable, accurate, versatile, economical and efficient.

Basically, the practice of the method of the present invention, utilizes radiation from the sun, i.e., visible sunlight, as a calibration source substituting for the invisible radiation from a selected satellite. Although the satellites are Geostationary (i.e., the azimuth and elevation dimensions to their positions remain constant) the sun makes a daily sweep across the range of azimuths of the Satellites. In returning each day, the sun appears to be circuiting 360 degrees every 24 hours, which arithmetically works out to an apparent azimuth change rate of approximately four (4) minutes per azimuth degree. There are seasonal fluctuations in the actual rate, but the average provides ample accuracy which allows for inaccuracy in the installer's watch for the one or two angular degrees of accuracy required in satellite reception. The apparent position of the sun in both azimuth and elevation, as a function of time and date for any Earth site, has long been understood and quantified with considerable precision by astronomers.

Accordingly, the practice of the present invention applies to installation of satellite reception systems using the astronomers' understanding of when the sun will appear at a useful direction for the desired satellites, relative to any given location on Earth, at any given date. In this way, it is possible to optimize non-interfering site selection for the receiving dish and alignment of the dish with the selected satellite. Hence, the use of astronomers' knowledge and a timepiece substitutes for both compass and inclinometer so that the visible sunlight substitutes for the invisible satellite signal in determining the location of the dish for an unobstructed view of the satellite. In addition, known differences in elevation between the selected satellite and the sun on a given date and time, enable adjustments of the dish's orientation relative to the sun, through use of shadows from the dish's structure falling upon a suitable reference scale, so that alignment of the dish with the selected satellite can be successfully achieved in a very simple and easy manner. In other words, the present invention utilizes specific times when the sun will be shining from the azimuth directions of one or more geostationary satellites, so that observation of where the sunshine and shadows fall, guides the selection of site for obstruction-free reception from such satellites and guides the orientation of the Dish to the satellite.

More particularly, by way of example and not necessarily by way of limitation, the present invention facilitates the optimization of site selection and dish placement by using the satellite's position, i.e., its azimuth, relative to the sun which allows an installer to use sunlight and shadows as a guide for placing the satellite dish so that there is unobstructed reception. In other words, at different times throughout the year, the sun will be positioned relative to a particular satellite such that, if the dish is placed in complete sunlight, there is no obstruction between the satellite dish and the satellite transmitter. However, if the dish is placed so that shadows fall upon its face, then this indicates that some sort of obstruction exists, e.g., a building, a tree or the like, which can interfere with signal reception.

In this way, the improved method of the present invention can be used for site surveys prior to system acquisition. Here, the prospective purchaser of a system simply observes the range of available sites for dish installation, in accordance with the present invention, and, depending upon the time of year and time of day, he will know where a particular satellite is located relative to the sun. Accordingly, if the desired location provides sufficient sunlight such that the dish would not be located in any shadows, the prospective purchaser will know that there is unobstructed reception. If, however, the prospective purchaser determines that the considered dish location(s) would result in shadows falling upon the face of the dish, then he knows that some sort of obstruction exists between that dish site and the satellite which may interfere with signal reception.

As will be appreciated by one of ordinary skill in the art, there are times throughout the year in which the sun will either be higher than the satellite transmitter (as in summer) or the sun will be lower than the satellite transmitter (as in winter). In this case, an alternative embodiment of the present invention may be used.

In the winter, for example, it is possible that a selected location will provide adequate and unobstructed signal reception, but the site may actually be in the shadows at the specified time and day. Nevertheless, one of ordinary skill in the art will know that the sun is considerably lower on the horizon than the satellite of interest. In this way, using standard trigonometry, a user of the present invention can easily discern how far beyond a particular reference (i.e., a potential obstruction) a shadow actually extends before the selected site becomes obstructed. In other words, if the dish system is in the shadows, but the trigonometric calculations show that if the sun were actually at the same elevation as the satellite, at the specified time and day, that no shadow would then be present at the site, then the site is obstruction free and a proper choice for antenna location. In this way, the present invention compensates for this winter shadow phenomenon.

In addition, the method of the present invention uses calibration marks or other suitable indica placed upon the face of the dish and the feed to allow the use of shadows created by the feed or the like in setting the azimuth and elevation of the dish for a particular satellite. For clarification of this application of the present invention, the term "Dish" is used to signify the full range of devices used to gather signals from satellite transmitters. A Dish is a reflective concentrator which bounces the satellite's signals back in the direction from which they have come into a feed. The feed is, thus, physically placed out in the general direction from which the Dish is gathering the signal. The shadow of this feed will, therefore, fall upon the face of the Dish, and/or on the structure supporting the feed and marks on that Dish face and/or feed support will offer guidance in orienting the Dish to the sun's azimuth direction, and to the relative amount of elevation by which the sun is higher, or lower, than the satellite.

Horns, yagiis, flat plates, and phased arrays have no feed structure permanently extending out in the direction from which they are receiving signal, so a temporary shadow casting, and/or capturing, attachment is provided and attached to facilitate this method of orienting these devices to the satellite. This allows for ease of orientation and alignment of the system. One prime advantage of the method of the present invention is that it is much easier to use than prior art approaches to site selection. All a prospective purchaser or installer need do is position the satellite dish relative to the sun (at a selected time and place throughout the year) so that no shadows fall upon its face to ensure that there is unobstructed reception.

As previously indicated, the present invention may also be used with systems other than dish systems, i.e. any receiving surface for incident radiation e.g., yagiis, flat mounts and the like. In this case, these systems do not typically provide a structure that may be used to create or form a shadow for use in aligning an antenna in accordance with the present invention. Accordingly, it is envisioned that any suitable structure can be either temporarily or permanently mounted to such radiation receiving devices to provide the necessary shadow indicia against any arbitrary or selected reference.

One advantage of the present invention is the ability to select a site that is less prone to theft or vandalism. As dish systems become smaller and more portable, the risk of such theft or vandalism increases. The present invention facilitates location of a relatively inaccessible area that still provides adequate signal reception by the dish or antenna. For example, the roof of a tall building could be selected as a possible safe site for a dish system. If the sun is shining, at a specified time and day, over the entire area, then the installer or purchaser knows that there is unobstructed signal reception between the dish and the satellite transmitter throughout the entire area of the potential location.

Another advantage is that the method, in accordance with the present invention, is very economical. Once, an installer knows the relative position of the satellite to the sun, site optimization can be accomplished. This eliminates the need for costly angle measuring instrumentation.

Still another advantage is that the method of the present invention is versatile in that it can be used anywhere throughout the world and at anytime throughout the year since the time when the azimuth of the sun will be coincident with the satellite and the elevation difference between the satellite and the sun can be readily determined for any longitude and latitude and for any particular day.

Another advantage of the present method is that when the sun's azimuth is the same as that of the satellite, the sun's light provides a reliable, accurate and efficient indication of satellite signal reception by clearly indicating (via shadows) whether something exists that will obstruct reception.

Furthermore, the present method can use the same concept of sunlight and shadows to aid in determining and optimizing the alignment and orientation of the dish relative to the satellite transmitter.

Other features and advantages of the present invention will become apparent from the following more detailed description, taken in conjunction with the accompanying drawings, which illustrate, by way of example, the features of the present invention.

BRIEF DESCRIPTION OF THE DRAWINGS

FIGS. 4A–4I are graphic representations illustrating the relationship between the sun's elevation and a selected satellite transmitter for various locations throughout the world for each month of the year.

DETAILED DESCRIPTION OF THE PREFERRED EMBODIMENTS

As previously indicated, the practice of the method of the present invention utilizes radiation from the sun, i.e., visible sunlight and/or shadows, as a calibration source substituting for the invisible radiation from a selected satellite. In this way, one can easily optimize non-interfering site selection for the receiving dish and alignment of the dish with the selected satellite. Hence, the visible sunlight substitutes for the invisible satellite signal in determining the location of the dish for an unobstructed view of the satellite. In addition, known differences in elevation between the selected satellite and the sun on a given date and time, enable adjustments of the dish orientation relative to the sun, through the use of shadows from the dish's own structure falling upon a suitable reference scale, so that alignment of the dish with the selected satellite can be successfully achieved in a very simple and easy manner.

Figure 1:
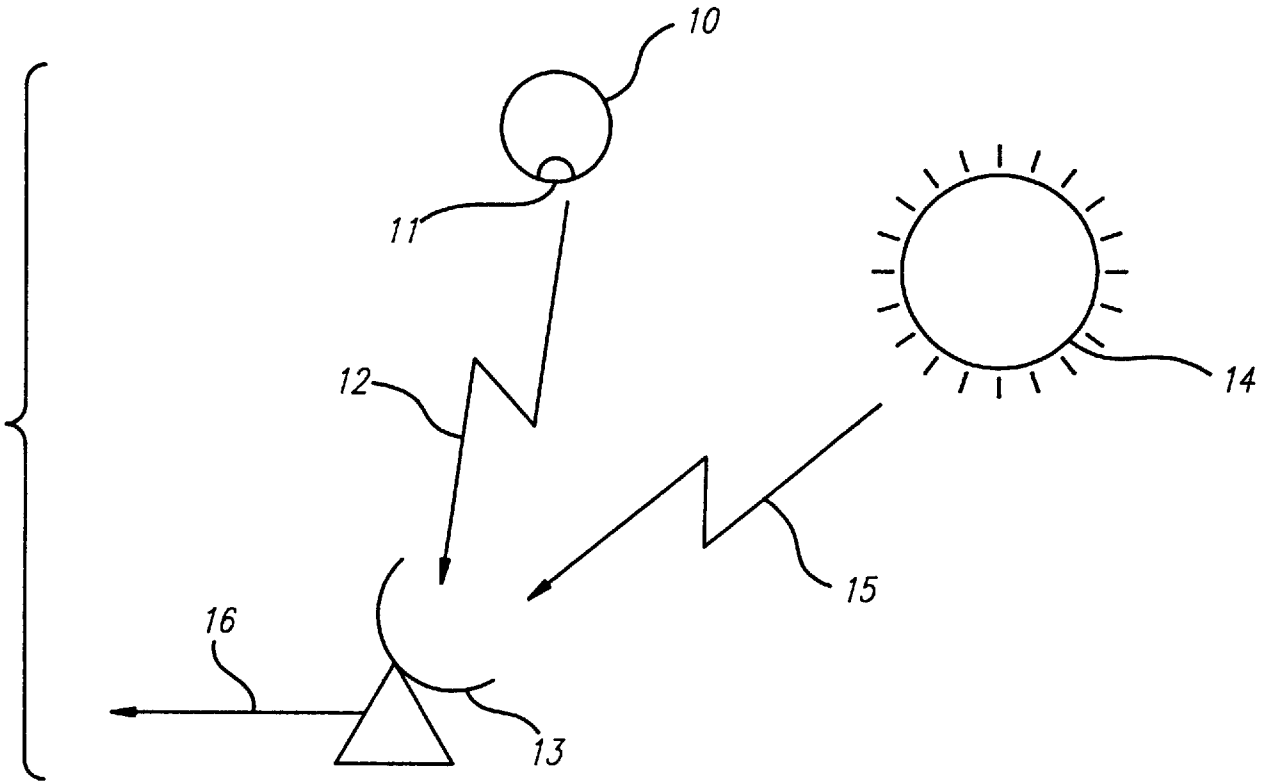
FIG. 1 is a schematic view of a typical site where a satellite dish is to be installed.

Referring now to the drawings, wherein like numbers denote like or corresponding elements throughout the drawings, and more particularly to FIG. 1, there is shown a schematic diagram of a satellite system adapted for dish site selection evaluation and for alignment optimization of dish to satellite, in accordance with the practice of the method of the present invention. In FIG. 1, a transmitter 11 of a satellite 10 transmits a high frequency r.f. signal from space to a receiving antenna or dish 13 on the ground. A conventional amplifier/converter at the dish 13 directs an I.F. signal over line 16, which may be a coaxial cable or the like, to any suitable receiver (not shown).

In addition, the sun 14 directs visible radiation 15, i.e., sunlight, which also impinges upon the dish 13 in the absence of any intervening obstruction. The sun 14, by virtue of visible sunlight, provides a substitute for the satellite 10 in visually assessing the proposed site for location of the dish 13, to facilitate visual alignment and obviate the need for expensive angle measurement devices. If the proposed site for the antenna dish 13 is a good one, the face of the dish will be in sunlight and, if the location of the sun 14 relative to the satellite 10 is known, then the dish's elevation can subsequently be appropriately adjusted to optimally align the dish with the selected satellite.

Figure 2:
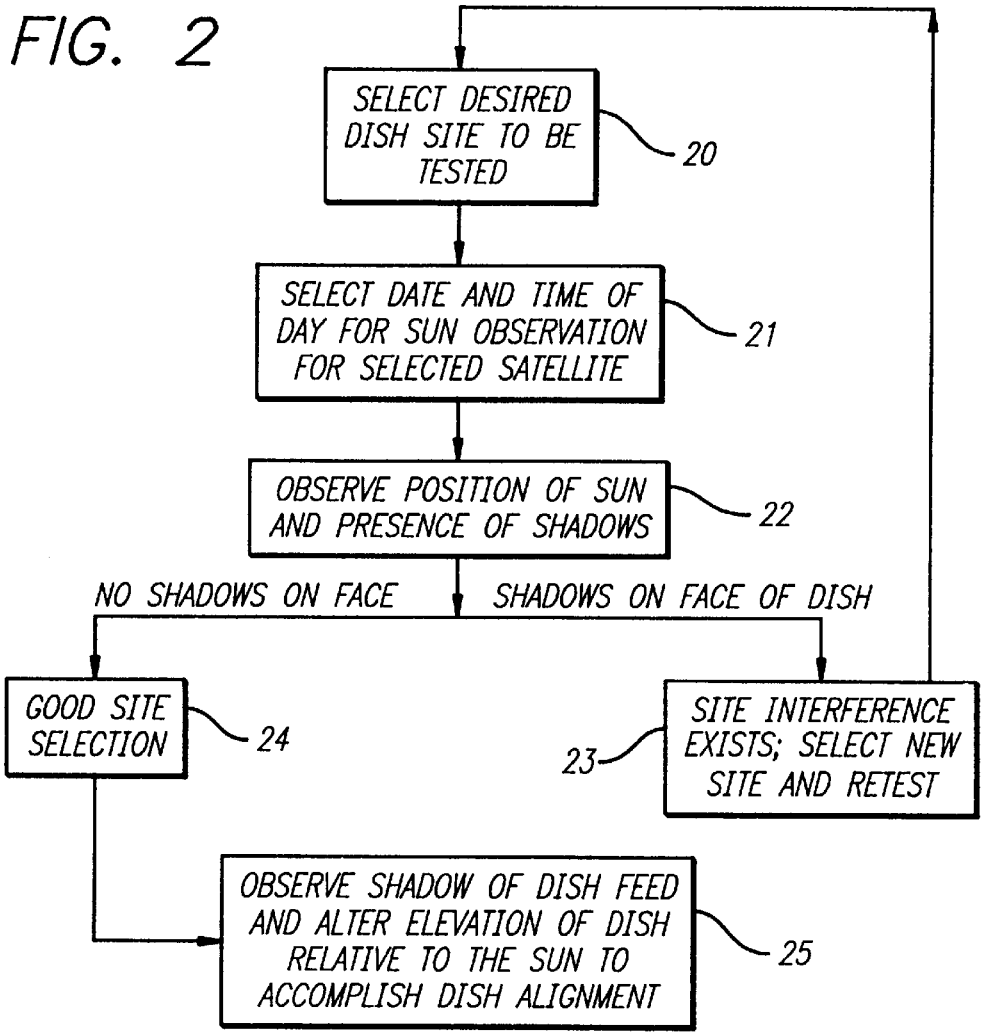
FIG. 2 is a flowchart of the site selection and dish alignment optimization, in accordance with the present invention.

As best observed in FIG. 2, the steps used in the practice of the present invention for optimizing location and alignment are illustrated by way of a schematic flowchart.

In step 20, the proposed range of possible sites for location of the dish 13 is selected and designated for evaluation.

In step 21, appropriate tables are referred to which relate, for a specific location on the planet, the date and time of day to the location of the sun relative to a selected satellite.

In step 22, the position of the sun 14 is observed and the each possible dish site is inspected to visually determine if it is in complete sunlight or in the shadow of some intervening objects such as mountains, trees, building structures and the like, which would interfere with signal reception by the dish from the transmitter 11 on the satellite 10. If such shadows on the possible site for the dish, then a new satellite dish location must be selected and steps 20 through 22 must be repeated until a best site location, i.e., a site where the dish will be in sunlight, is found. This is illustrated in step 23 which indicates that, if shadows will fall on the dish 13, signal interference exists at the dish site and a new site must be selected and tested (indicated in FIG. 2 by a return from step 23 to step 20).

When a dish site is located that is in sunlight (no shadows on the face of the dish 13 from surrounding objects other than the antenna structure itself), step 24 indicates validation of a good dish site selection.

Furthermore, the present invention has the ability to select a site that is less prone to theft or vandalism. As dish systems become smaller and more portable, the risk of such theft or vandalism increases. The present invention facilitates location of a relatively inaccessible area that still provides adequate signal reception by the dish or antenna. For example, the roof of a tall building could be selected as a possible safe site for a dish system. If the sun is shining, at a specified time and day, over the entire area, then the installer or purchaser knows that there is unobstructed signal reception between the dish and the satellite transmitter throughout the entire area of the potential location.

In step 25, adjustments in elevation of the dish 13 are made based upon the known elevation of the selected satellite 10 relative to the sun 14, to optimize alignment of the dish with the selected satellite.

Figure 3:
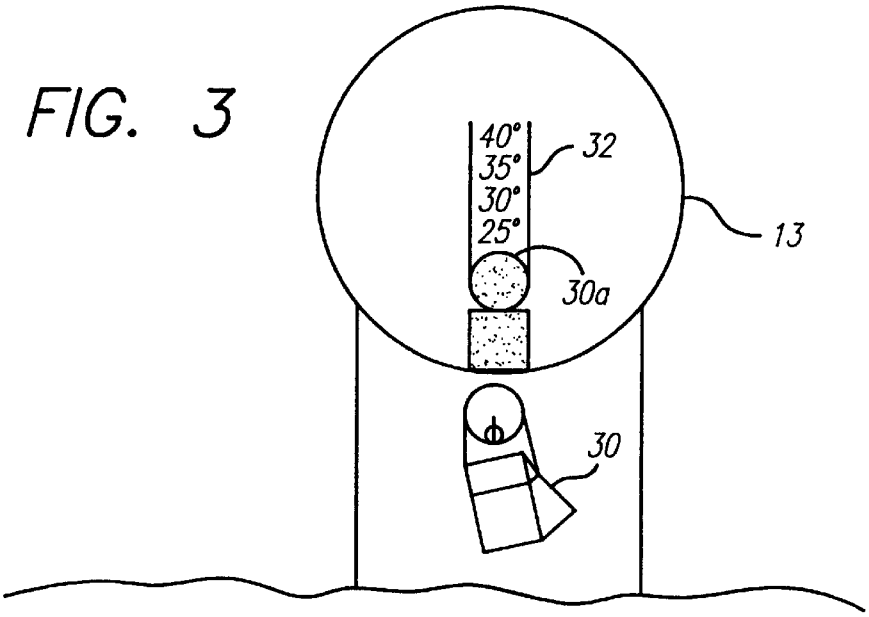
FIG. 3 is a prospective view illustrating the manner in which the shadow of the feed upon the dish can be used to align the antenna dish to a selected satellite.
Figure 4A:
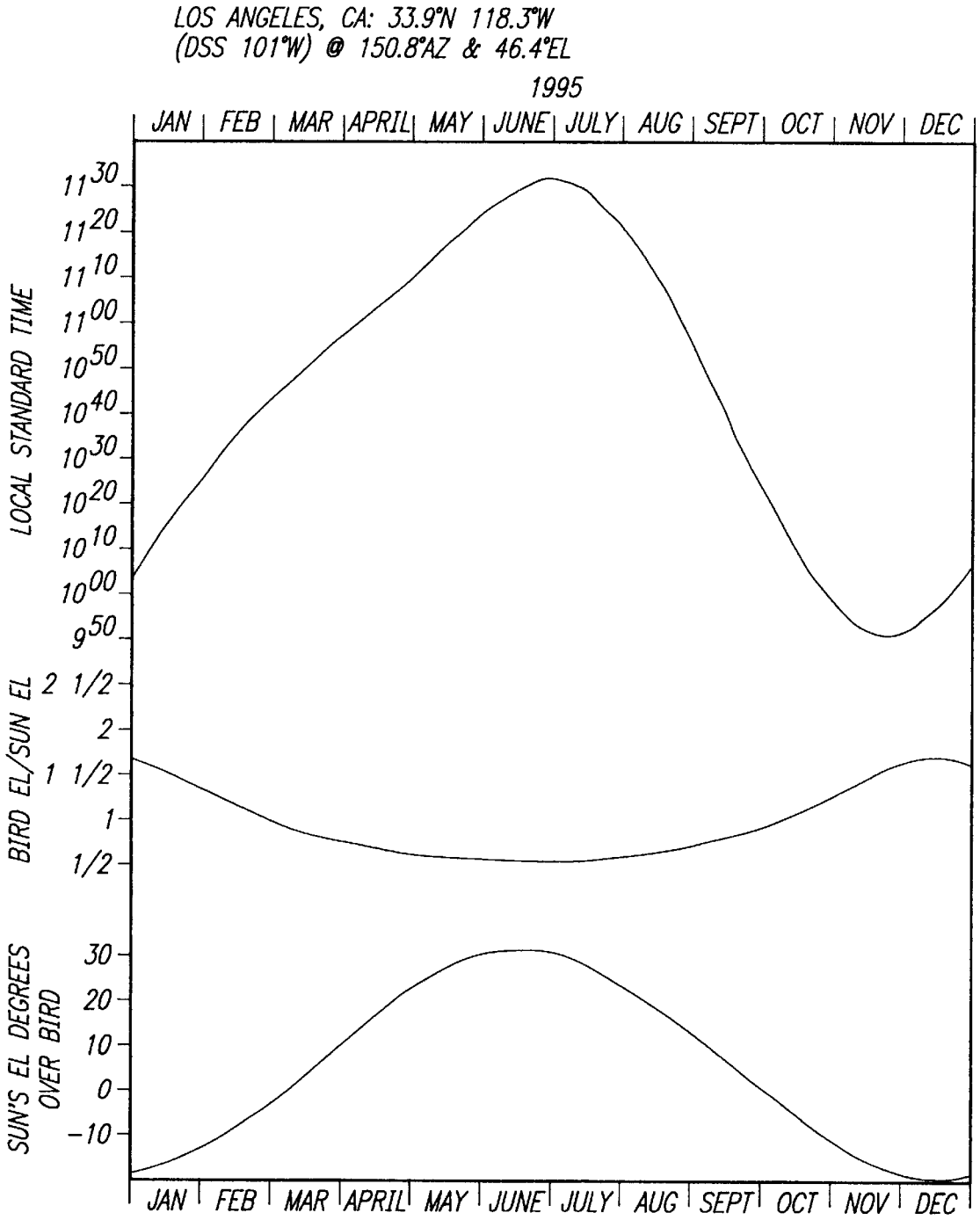
Figure 4B:
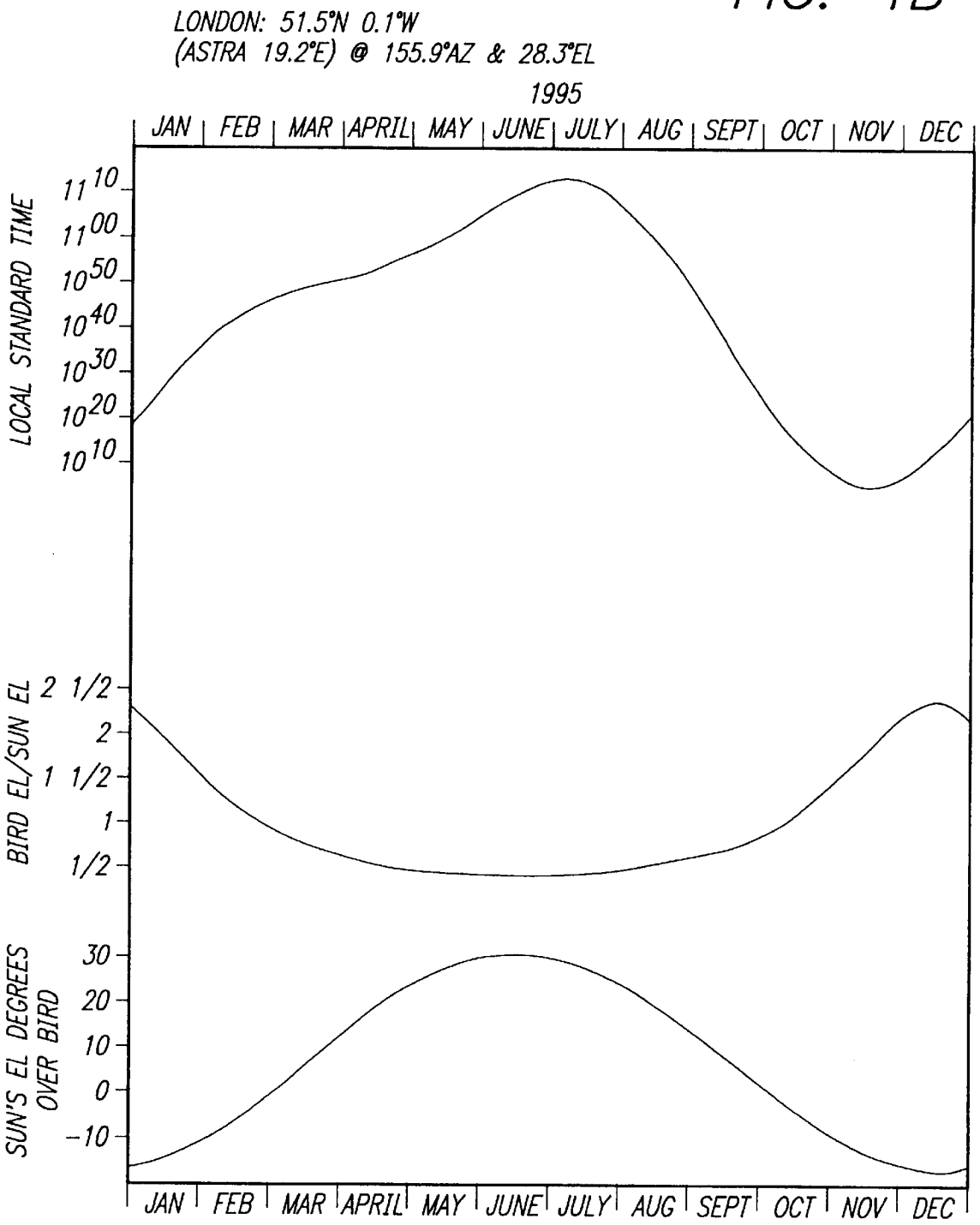
Figure 4C:
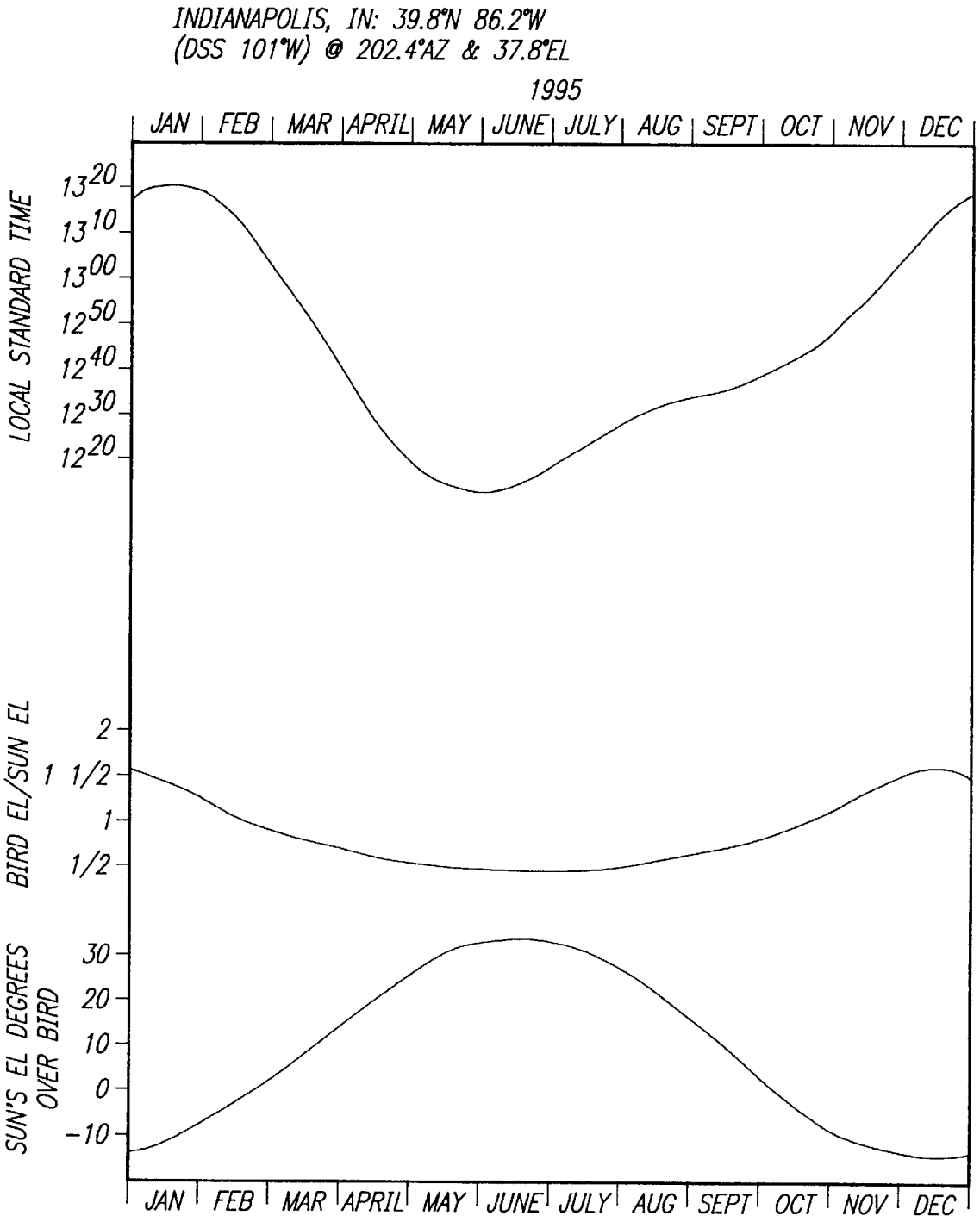
Figure 4D:
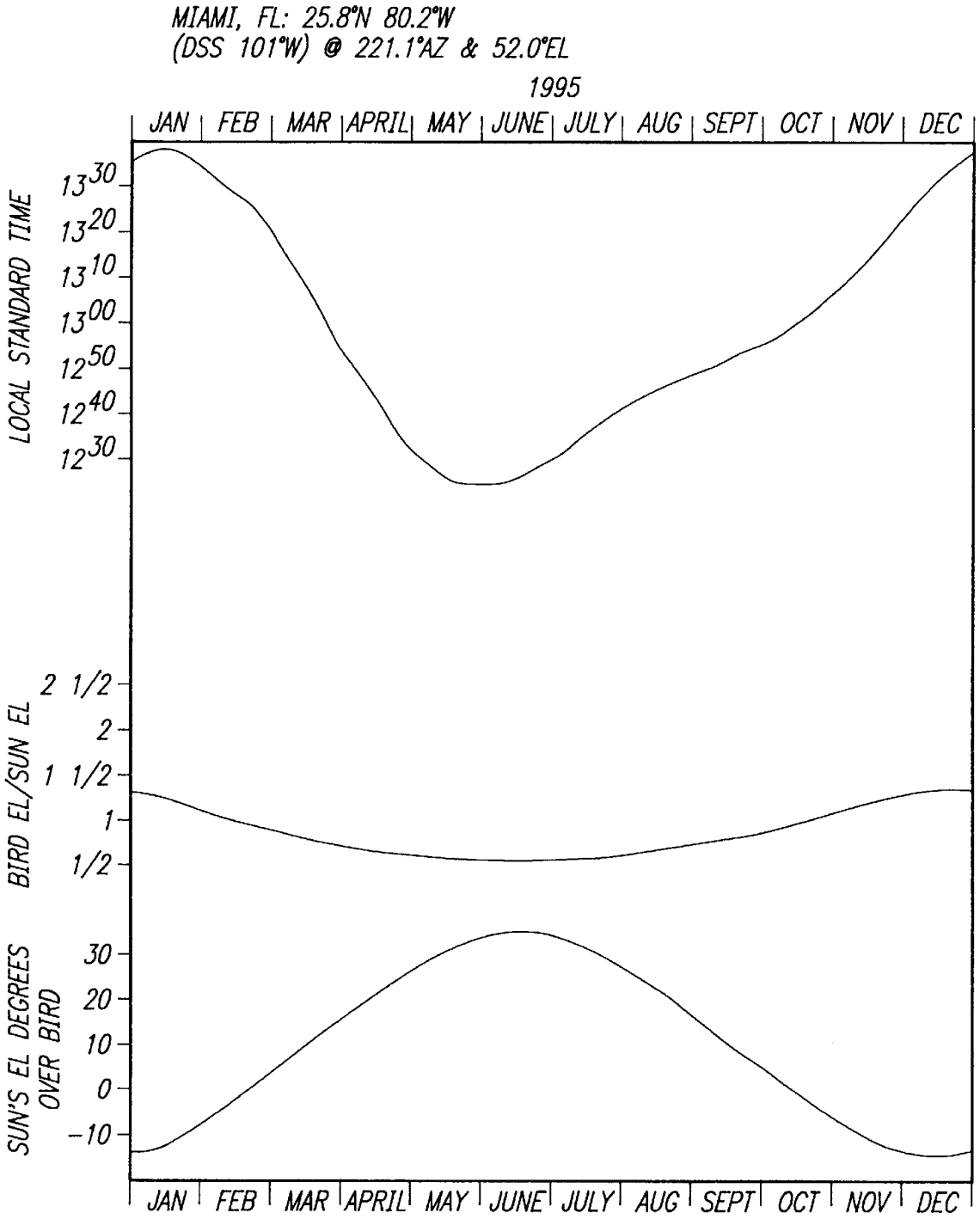
Figure 4E:
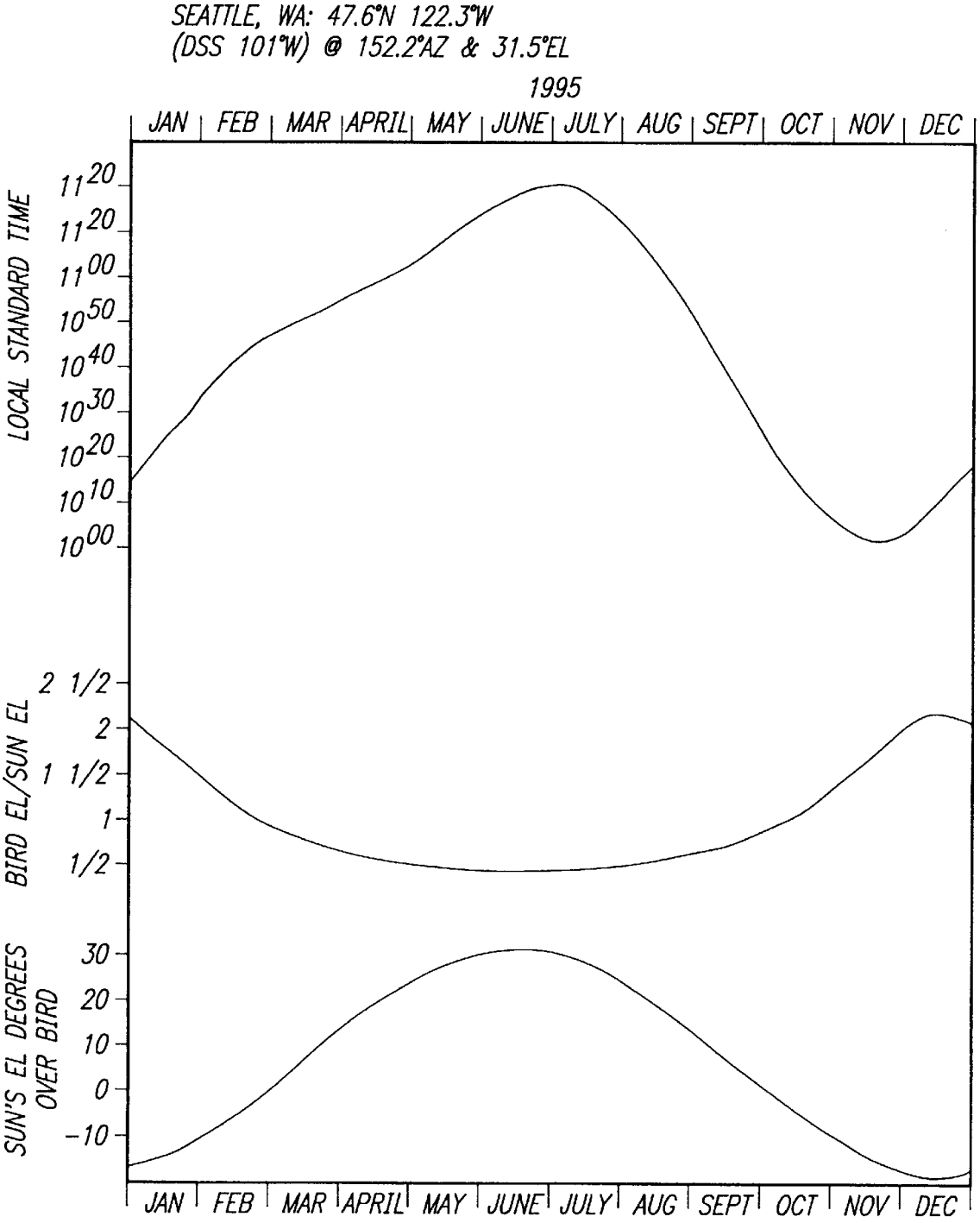
Figure 4F:
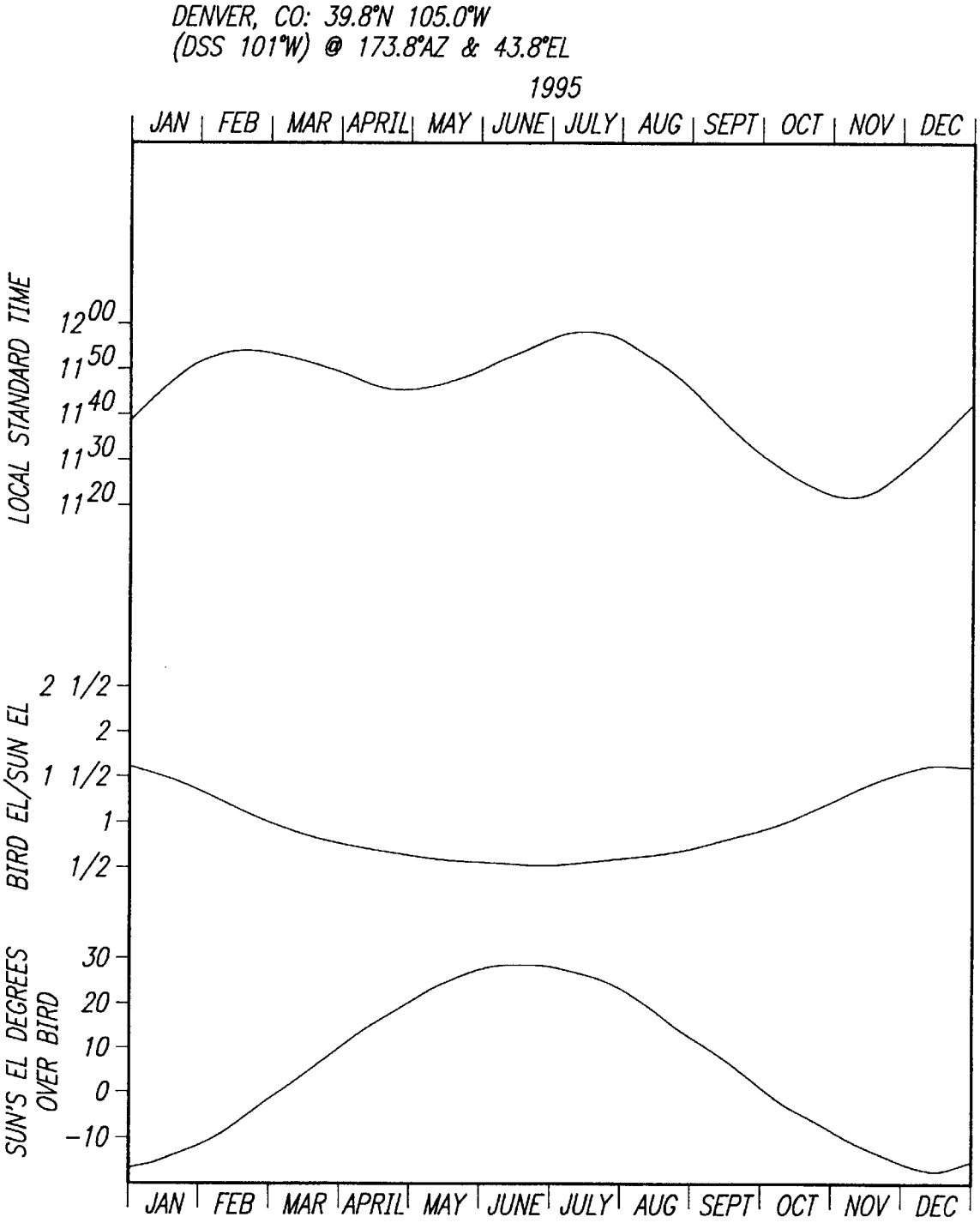
Figure 4G:
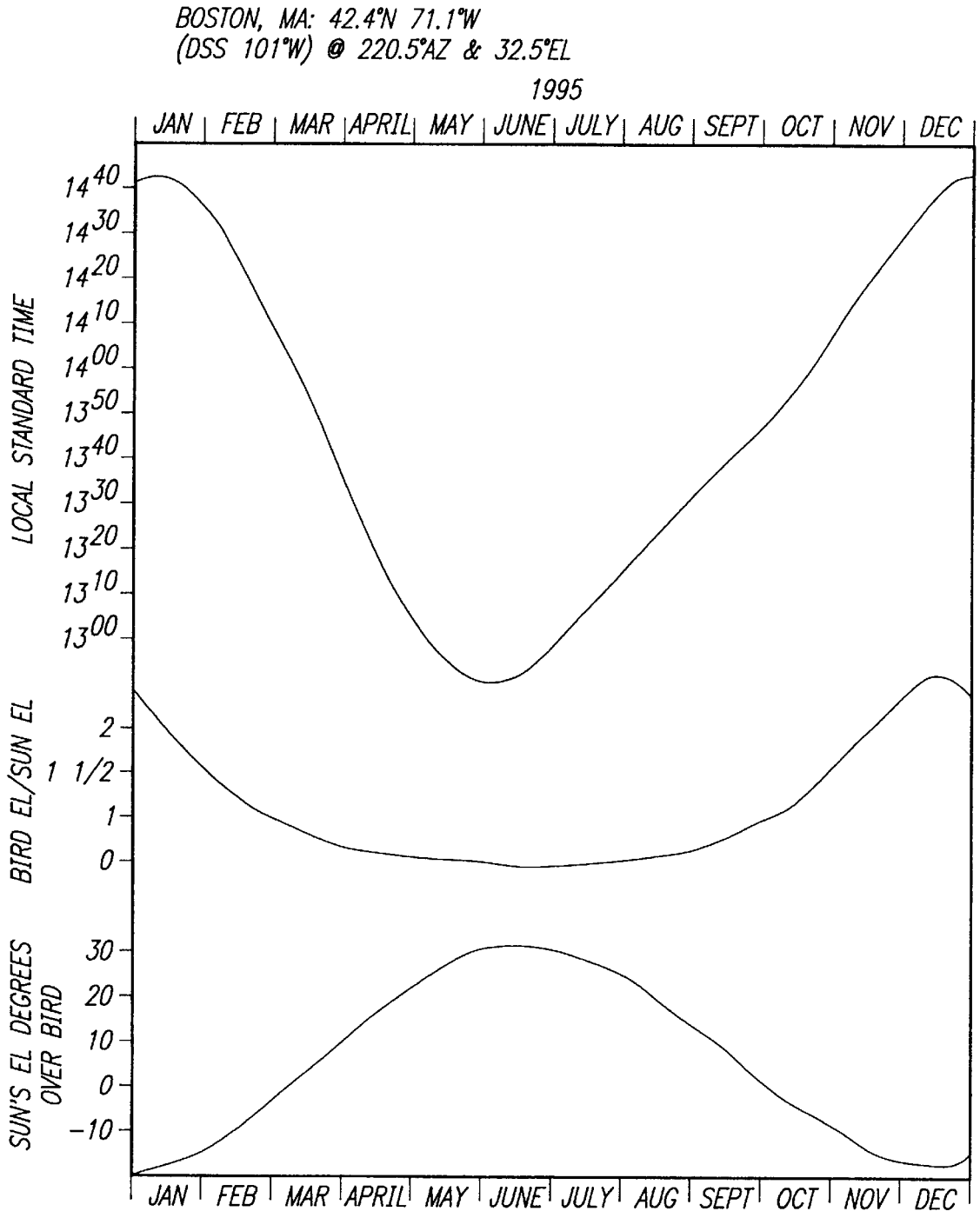
Figure 4H:
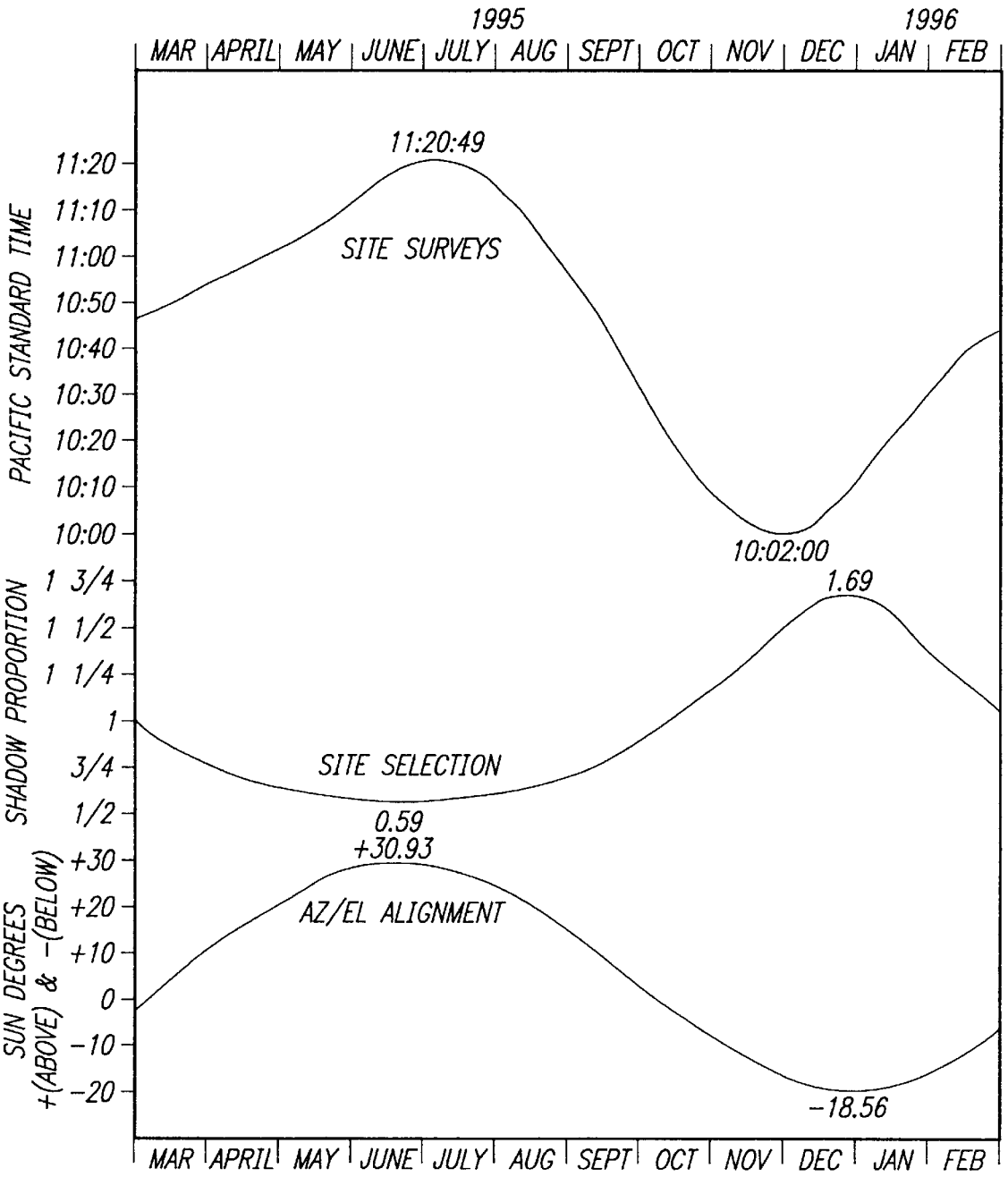
Figure 41:
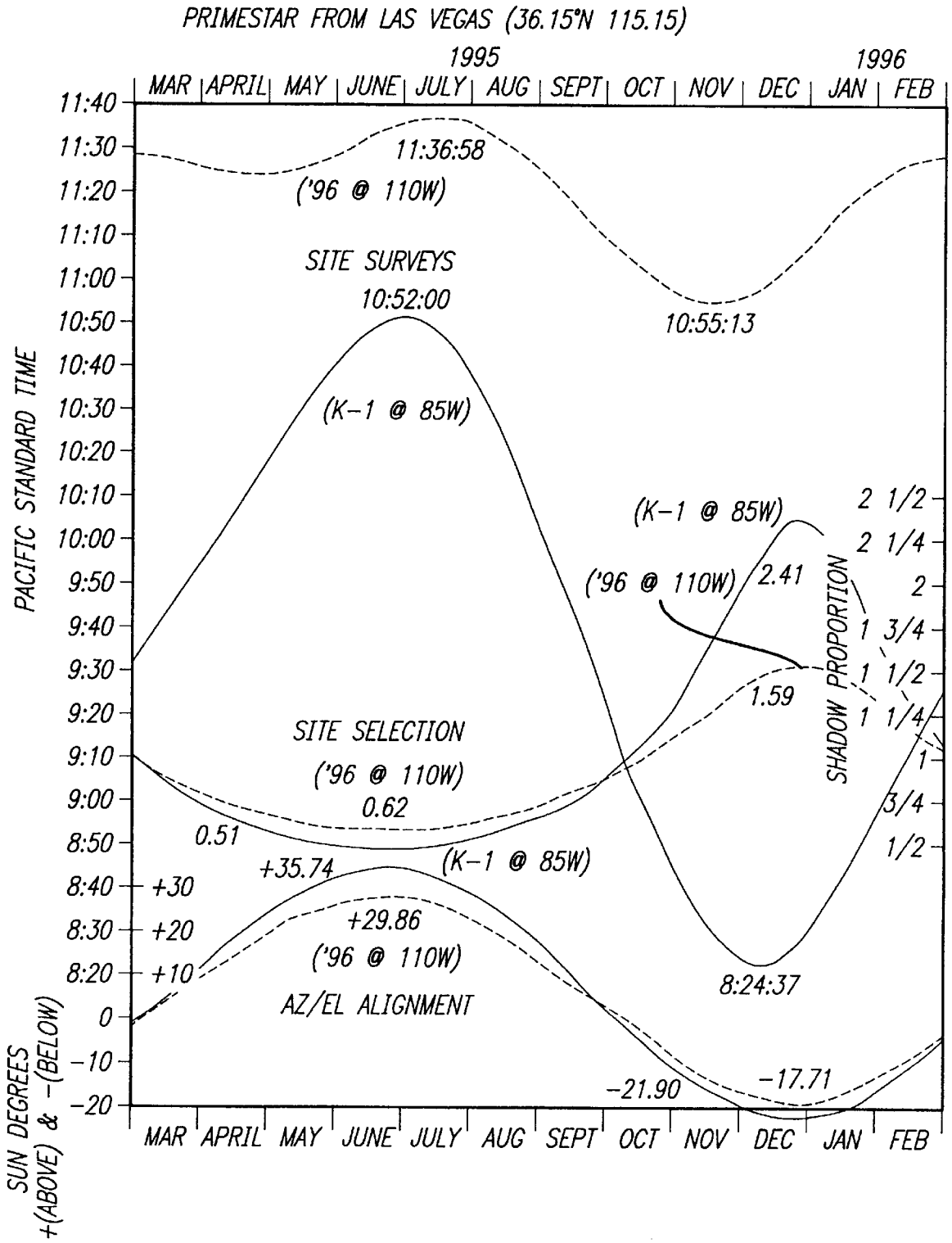

Referring now, to FIG. 3, and bearing in mind step 25 in FIG. 2, the shadow 30*a* of a dish feed 30 upon the surface of the dish 13 is used to adjust the azimuth, and elevation of the dish for alignment with the selected satellite 10. In this regard, an appropriate calibration or reference scale 32, shown calibrated by indices or reference marks for different degrees of elevation, may be provided on the face of the dish 13 so that the shadow 30*a* of a dish feed 30 can fall upon the scale to adjust azimuth and can be utilized to change the relative elevation of the dish for optimal alignment adjustment.

As previously indicated, the time and angular amount by which the sun 14 is over/under the selected satellite 10 can serve as a guide to orientation alignment of the dish 13 to the satellite. The prior art method for accomplishing this task is to set the elevation of the dish 13 by inclination measurement of the dish, or by marks on the dish support and to then turn the dish sweeping a wide range of azimuths in order to find the satellite 10. This requires care/work in order to verify that the support is plumb, lest the marks on the support be misleading and/or the dish's 13 elevation change as it is swept across the azimuth's. For clarification of this application of the present invention, use of the term "Dish" signifies the full range of devices used to gather signals from Satellite Transmitters. A Dish is a reflective concentrator which bounces the satellite's signals back in the direction from which they have come, into a feed. The feed is thus physically placed out in the general direction from which the Dish is gathering signal. The shadow of this feed will thus fall upon the face of the Dish, and/or on the structure supporting the feed, and marks on that Dish face and/or feed support will offer guidance to orienting the Dish to the sun's azimuth direction, and to the relative amount of elevation by which the sun is higher, or lower, than the satellite. Horns, Yagiis, Flat Plates, and Phased Arrays have no feed structure permanently extending out in the direction from which they are receiving signal, so a temporary shadow casting, and/or capturing, attachment is provided to facilitate this method of orienting these devices to the satellite.

In accordance with the present invention, marks can be placed on the face of the dish 13 and the feed support as shown in FIG. 3, to use the shadows of the feed in setting both the azimuth and elevation of the dish to be on the satellite 10. At the time when the sun 14 is at the same azimuth as the satellite 10, the dish 13 can be turned in azimuth so that the shadow 30*a* of the feed 30 falls on marks located down the centerline, i.e., a line of intersection along the symmetry plane of the dish, which contains the feed with the face of the dish, and so that the dish is mounted such that the centerline is in the local vertical plane in which elevation is measured. This action orients the azimuth of the dish 13 towards the satellite 10. Tipping of the dish 13 so that the feed shadow 30*a* falls on the marks for the angular amount by which the sun 14 is above/below the satellite 10, orients the elevation of the dish 13 towards the satellite. This works with off-set, and center-feed dishes and frees the installer from the need to make the dish's support plumb and from the need to sweep/search a wide range of azimuths.

Derivation of the sun's times, and relative elevations, can be done in many ways. However, it depends upon the site's latitude and longitude, the longitude of a satellite, and the date, since all of the above factors are important to the correct derivation of the apparent position of the sun. Accordingly, the sun's azimuth time, and elevation differences from the satellites elevation, can be determined and placed in the form of equations, tables or graphs. These specific times can be calculated either generally or more specifically based upon specific requests, utilizing software or standardized tables. The following Table A provides examples of the times for a variety of locations and satellites for a sample date of Oct. 5, 1994. This date is at the Fall occurrence of the sun's coincidence with the satellites as viewed from near 40 degrees north latitude. Of course, at other dates, the sun's times will be different and the sun will either be above the satellite (in the summer) or below the satellite (in the winter).

TABLE A

| Site Location | Lat. | Long. | Satellite | Long. | Azim. | El'n | Sun's Time | El'n |
|---|---|---|---|---|---|---|---|---|
| Denver, CO. | 39.8N | 105.0W | DirecTV | 101.0W | 173.8 | 43.8 | 12:30:52pm MDT | +1.4 |
| Denver, CO. | 39.8N | 105.0W | Satcom K1 | 85.0W | 150.4 | 39.6 | 11:20:32am MDT | +1.4 |
| Durban, So. Africa | 29.8S | 31.1E | Astra | 19.2E | 337.1 | 52.8 | 12:24:44pm Std | +10.4 |
| Kobe, Japan | 34.7N | 135.7E | SuperBird B | 162.0E | 138.4 | 40.6 | 9:45:37am Std | +1.1 |
| London, England | 51.5N | 0.1W | Astra | 19.2E | 155.4 | 28.3 | 11:24:58am GDT | +2.7 |
| Memphis, Tenn. | 35.2N | 89.9W | DirecTV | 101.0W | 198.7 | 47.5 | 1:37:28pm CDT | +0.8 |
| Memphis, Tenn. | 35.2N | 89.9W | Satcom K1 | 85.0W | 171.4 | 48.8 | 12:25:42pm CDT | +0.8 |
| Philadelphia, PA | 40.0N | 75.2W | DirecTV | 101.0W | 216.9 | 36.6 | 2:42:21pm EDT | +1.6 |
| Philadelphia, PA | 40.0N | 75.2W | Satcom K1 | 85.0W | 195.0 | 42.6 | 1:32:15pm EDT | +1.5 |
| Reno, Nevada | 39.5N | 119.8W | DirecTV | 101.0W | 151.8 | 40.3 | 11:24:40am PDT | +1.4 |
| Reno, Nevada | 39.5N | 119.8W | Satcom K1 | 85.0W | 132.5 | 32.0 | 10:15:08am PDT | +1.4 |
| Sydney, Australia | 33.9S | 151.1E | AusSat A3 | 156.0E | 8.7 | 50.2 | 11:27:02am Std | +10.2 |

More optimum "polar" analyses, for azimuth/elevation at these sites are set forth in the following Tables B–G.

TABLE B

Longitude: 75.2 WEST Latitude: 40 NORTH
Compass Error: 11 ¼ WEST
Around: PHILADELPHIA. PENN AXIS = 40.70 ZENITH = 46.27

| SATELLITE DESIGNATN | FREQ BAND | TRUE AZMTH | ELEV ANGL | EXTRM SLOPE | ERROR D/10K |
|---|---|---|---|---|---|
| AURORA 2 | C: | 252.4 | 11.2 | 78.75 | 17 |
| SATCOM C1 | C: | 251.0 | 12.7 | 77.25 | 11 |
| SATCOM C4 | C: | 249.6 | 14.2 | 75.83 | 5 |
| GALAXY 1 | C: | 248.0 | 15.7 | 74.27 | −1 |
| SATCOM C3 | C: | 246.4 | 17.2 | 72.80 | −7 |
| ASC 1 | C&K: | 244.0 | 19.4 | 70.61 | −13 |
| GLX5 + GSt2 | C&K: | 241.5 | 21.6 | 68.45 | −17 |
| TEL3 + SBS5 | C&K: | 239.8 | 23.0 | 67.03 | −19 |
| MORELOS 2 | C&K: | 234.1 | 27.2 | 62.77 | −20 |
| ANIK C3 | K: | 232.3 | 28.5 | I/O's Center | |
| ANIK E1 | C&K: | 228.4 | 30.9 | 59.10 | −18 |
| MORELOS 1 | C&K: | 226.4 | 32.1 | 57.93 | −16 |
| ANIK E2 | C&K: | 224.3 | 33.2 | 56.80 | −14 |
| G-STAR 4 | K: | 221.7 | 34.5 | 55.49 | −11 |
| G-Star 1 | K: | 219.4 | 35.6 | 54.40 | −8 |
| SPACENET4 | C&K: | 216.9 | 36.6 | 53.36 | −5 |
| DirecTV | K: | 216.9 | 36.6 | 53.36 | −5 |
| GALAXY 4 | C&K: | 214.5 | 37.6 | 52.37 | −3 |
| TEL'R 401 | C&K: | 211.9 | 38.6 | 51.45 | 0 |

TABLE B-continued

Longitude: 75.2 WEST Latitude: 40 NORTH
Compass Error: 11 ¼ WEST
Around: PHILADELPHIA. PENN AXIS = 40.70 ZENITH = 46.27

| SATELLITE DESIGNATN | FREQ BAND | TRUE AZMTH | ELEV ANGL | EXTRM SLOPE | ERROR D/10K |
|---|---|---|---|---|---|
| SBS 6 | K: | 209.3 | 39.4 | 50.59 | 3 |
| GALAXY 3 | C: | 207.2 | 40.0 | 49.98 | 5 |
| G-STAR 3 | K: | 206.5 | 40.2 | I/O's Center | |
| GALAXY 7 | C&K: | 203.8 | 40.9 | 49.07 | 9 |
| SPACENET3 | C&K: | 198.0 | 42.1 | 47.85 | 13 |
| TEL2 + K1 | C&K: | 195.0 | 42.6 | 47.37 | 15 |
| SATCOM K2 | K: | 189.0 | 43.3 | 46.66 | 17 |
| SBS 4 | K: | 182.8 | 43.7 | 46.30 | 19 |
| GLX6 + SBS2 | C&K: | 178.1 | 43.7 | 46.28 | 20 |
| SATCOM 2 | C: | 175.0 | 43.6 | 46.39 | 19 |
| SPACENET2 | C&K: | 170.4 | 43.3 | 46.71 | 18 |

'I/O' means Inclined (Unstable) Orbit
These Birds are not shown on Sat Sites.
RESIDUAL TRACKING ERROR RE-CAP
<<CONTROLLING ERROR MINIMIZATION
AVERAGE ERROR = .00119 DEGREES
MAXIMUM ERROR = .00205 DEGREES<<

TABLE C

Longitude: 89.95 WEST Latitude: 35.15 NORTH
Compass Error: 2 ¼ EAST
Around: MEMPHIS. TENNESSEE AXIS = 35.83 ZENITH = 40.82

| SATELLITE DESIGNATN | FREQ BAND | TRUE AZMTH | ELEV ANGL | EXTRM SLOPE | ERROR D/10K |
|---|---|---|---|---|---|
| AURORA 2 | C: | 243.5 | 24.5 | 65.50 | 4 |
| SATCOM C1 | C: | 241.8 | 26.1 | 63.95 | −1 |
| SATCOM C4 | C: | 240.2 | 27.5 | 62.49 | −4 |
| GALAXY 1 | C: | 238.4 | 29.1 | 60.90 | −7 |
| SATCOM C3 | C: | 236.5 | 30.6 | 59.40 | −9 |
| ASC 1 | C&K: | 233.7 | 32.8 | 57.22 | −10 |
| GLX5 + GSt2 | C&K: | 230.6 | 34.9 | 55.10 | −11 |
| TEL3 + SBS5 | C&K: | 228.5 | 36.3 | 53.74 | −11 |
| MORELOS 2 | C&K: | 221.3 | 40.2 | 49.78 | −9 |
| ANIK C3 | K: | 218.9 | 41.3 | I/O's Center | |
| ANIK E1 | C&K: | 213.9 | 43.4 | 46.61 | −4 |
| MORELOS 1 | C&K: | 211.2 | 44.3 | 45.68 | −3 |
| ANIK E2 | C&K: | 208.5 | 45.2 | 44.81 | −1 |
| G-STAR 4 | K: | 205.0 | 46.1 | 43.86 | 2 |
| G-Star 1 | K: | 201.9 | 46.9 | 43.13 | 3 |
| SPACENET4 | C&K: | 198.7 | 47.5 | 42.49 | 4 |
| DirecTV | K: | 198.7 | 47.5 | 42.49 | 4 |
| GALAXY 4 | C&K: | 195.5 | 48.1 | 41.95 | 5 |
| TEL'R 401 | C&K: | 192.1 | 48.5 | 41.51 | 6 |
| SBS 6 | K: | 188.7 | 48.8 | 41.17 | 7 |
| GALAXY 3 | C: | 186.2 | 49.0 | 40.99 | 7 |
| G-STAR 3 | K: | 185.3 | 49.1 | I/O's Center | |
| GALAXY 7 | C&K: | 181.8 | 49.2 | 40.83 | 8 |
| SPACENET3 | C&K: | 174.9 | 49.1 | 40.94 | 7 |
| TEL2 + K1 | C&K: | 171,4 | 48.8 | 41.16 | 8 |
| SATCOM K2 | K: | 164.7 | 48.1 | 41.92 | 5 |
| SBS 4 | K: | 158.2 | 46.9 | 43.09 | 3 |
| GLX6 + SBS2 | C&K: | 153.6 | 45.8 | 44.22 | 0 |
| SATCOM 2 | C: | 150.6 | 44.9 | 45.08 | −2 |
| SPACENET2 | C&K: | 146.4 | 43.5 | 46.51 | −3 |

'I/O' means inclined (Unstable) Orbit
These Birds are not shown on Sat Sites.
RESIDUAL TRACKING ERROR RE-CAP
<<CONTROLLING ERROR MINIMIZATION
AVERAGE ERROR = .00108 DEGREES<<
MAXIMUM ERROR = .00108 DEGREES<<

TABLE D

Longitude: 105 WEST Latitude: 39.75 NORTH
Compass Error: 11 ½ EAST
Around: DENVER. COLORADO AXIS = 40.46 ZENITH = 45.99

| SATELLITE DESIGNATN | FREQ BAND | TRUE AZMTH | ELEV ANGL | EXTRM SLOPE | ERROR D/10K |
|---|---|---|---|---|---|
| AURORA 2 | C: | 226.5 | 32.3 | 57.74 | −1 |
| SATCOM C1 | C: | 224.3 | 33.5 | 56.55 | −1 |
| SATCOM C4 | C: | 222.2 | 34.5 | 55.46 | −3 |
| GALAXY 1 | C: | 219.7 | 35.7 | 54.29 | −3 |
| SATCOM C3 | C: | 217.3 | 36.8 | 53.24 | −3 |
| ASC 1 | C&K: | 213.6 | 38.2 | 51.77 | −3 |
| GLX5 + GSt2 | C&K: | 209.6 | 39.6 | 50.43 | −2 |
| TEL3 + SBS5 | C&K: | 206.9 | 40.4 | 49.62 | −1 |
| MORELOS 2 | C&K: | 198.1 | 42.4 | 47.59 | 1 |
| ANIK C3 | K: | 195.3 | 42.9 | I/O's Center | |
| ANIK E1 | C&K: | 189.5 | 43.6 | 46.42 | 2 |
| MORELOS 1 | C&K: | 186.6 | 43.8 | 46.20 | 3 |
| ANIK E2 | C&K: | 183.6 | 43.9 | 46.05 | 3 |
| G-STAR 4 | K: | 180.0 | 44.0 | 45.99 | 3 |
| G-Star 1 | K: | 176.9 | 44.0 | 46.04 | 3 |
| SPACENET4 | C&K: | 173.8 | 43.8 | 46.18 | 3 |
| DirecTV | K: | 173.8 | 43.8 | 46.18 | 3 |
| GALAXY 4 | C&K: | 170.7 | 43.6 | 46.41 | 2 |
| TEL'R 401 | C&K: | 167.6 | 43.3 | 46.73 | 2 |
| SBS 6 | K: | 164.6 | 42.9 | 47.15 | 1 |
| GALAXY 3 | C: | 162.4 | 42.5 | 47.51 | 1 |
| G-STAR 3 | K: | 161.6 | 42.4 | I/O's Center | |
| GALAXY 7 | C&K: | 158.7 | 41.8 | 48.23 | 0 |
| SPACENET3 | C&K: | 153.1 | 40.4 | 49.62 | −1 |
| TEL2 + K1 | C&K: | 150.4 | 39.6 | 50.43 | −2 |
| SATCOM K2 | K: | 145.2 | 37.8 | 52.24 | −3 |
| SBS 4 | K: | 140.3 | 35.7 | 54.29 | −3 |
| GLX6 + SBS2 | C&K: | 136.8 | 34.0 | 55.97 | −2 |
| SATCOM 2 | C: | 134.6 | 32.9 | 57.14 | −1 |
| SPACENET2 | C&K: | 131.4 | 31.0 | 58.98 | 1 |

'I/O' means inclined (Unstable) Orbit
These Birds are not shown on Sat Sites.
RESIDUAL TRACKING ERROR RE-CAP
<<CONTROLLING ERROR MINIMIZATION
AVERAGE ERROR = .00020 DEGREES
MAXIMUM ERROR = .00033 DEGREES<<

TABLE E

Longitude: .1 WEST Latitude: 51.5 NORTH
Compass Error: 5 WEST
Around: LONDON. ENGLAND AXIS = 52.18 ZENITH = 58.94

| SATELLITE NAME DESIGNATION | TRUE AZMTH | ELEV ANGL | EXTRM SLOPE | ERROR D/10K |
|---|---|---|---|---|
| PanAmSat 1 | 231.9 | 17.9 | 72.10 | −15 |
| Intelsat 603 | 221.2 | 22.9 | 67.10 | −14 |
| HISPASAT 1A | 216.4 | 24.7 | 65.27 | −12 |
| INTELSAT 601 | 213.5 | 25.7 | 64.27 | −9 |
| Intelgat K | 206.6 | 27.7 | 62.26 | −4 |
| Tv SAT - 2 | 203.9 | 28.4 | 61.61 | −2 |
| Olympus 1 | 203.6 | 28.4 | 61.55 | −2 |
| TDF 1 & 2 | 203.4 | 28.5 | 61.50 | −2 |
| Intelsat 515 | 202.4 | 28.7 | 61.29 | −1 |
| Telecom 2A | 190.1 | 30.6 | 59.40 | 6 |
| Telecom 2B | 186.3 | 30.9 | 59.12 | 7 |
| Intlesat 512 | 181.1 | 31.1 | 58.94 | 8 |
| THOR | 181.0 | 31.1 | 58.94 | 8 |
| Telecom 1C | 176.0 | 31.0 | 59.01 | 7 |
| Tele - X | 173.5 | 30.9 | 59.13 | 7 |
| Eutelsat 2F4 | 170.8 | 30.7 | 59.33 | 7 |
| Eutelsat 2F2 | 167.2 | 30.3 | 59.70 | 5 |
| Eutelsat 2F1 | 163.4 | 29.8 | 60.21 | 3 |
| Eutelsat 2F3 | 159.8 | 29.2 | 60.85 | 0 |
| ASTRA | 155.9 | 28.3 | 61.66 | −2 |
| DFS - 3 | 150.8 | 27.0 | 62.95 | −6 |
| DFS - 2 | 145.0 | 25.2 | 64.76 | −11 |

TABLE E-continued

Longitude: .1 WEST Latitude: 51.5 NORTH
Compass Error: 5 WEST
Around: LONDON. ENGLAND AXIS = 52.18 ZENITH = 58.94

| SATELLITE NAME DESIGNATION | TRUE AZMTH | ELEV ANGL | EXTRM SLOPE | ERROR D/10K |
|---|---|---|---|---|
| Intelsat 604 | 114.1 | 9.4 | 80.55 | 8 |
| Intelsat 602 | 111.7 | 7.8 | 82.19 | 16 |

RESIDUAL TRACKING ERROR RE-CAP:
AVERAGE ERROR = .00068 DEGREES
MAXIMUM ERROR = .00162 DEGREES<<
<<CONTROLLING ERROR MINIMIZATION

TABLE F

Longitude: 31.1 EAST Latitude: 29.85 SOUTH
Compass Error: 20 ¼ WEST
Around: DURBAN. SOUTH AFRICA AXIS = 30.47
ZENITH = 34.80

| SATELLITE NAME DESIGNATION | TRUE AZMTH | ELEV ANGL | EXTRM SLOPE | ERROR D/10K |
|---|---|---|---|---|
| PanAmSat 1 | 277.0 | 3.4 | 86.64 | 106 |
| Intelsat 603 | 282.7 | 12.5 | 77.48 | 38 |
| HISPASAT 1A | 285.3 | 16.4 | 73.64 | 16 |
| INTELSAT 601 | 286.9 | 18.6 | 71.37 | 8 |
| Intelsat K | 290.8 | 23.8 | 66.16 | −9 |
| TV SAT - 2 | 292.5 | 25.8 | 64.17 | −13 |
| Olympus 1 | 292.6 | 26.0 | 64.00 | −14 |
| TDF 1 & 2 | 292.7 | 26.2 | 63.83 | −14 |
| Intelsat 515 | 293.3 | 26.9 | 63.15 | −15 |
| Telecom 2A | 301.5 | 35.2 | 54.79 | −22 |
| Telecom 2B | 304.3 | 37.6 | 52.39 | −20 |
| Intlesat 512 | 308.4 | 40.7 | 49.29 | −16 |
| THOR | 308.5 | 40.8 | 49.22 | −17 |
| Telecom 1C | 313.0 | 43.6 | 46.36 | −12 |
| Tele - X | 315.5 | 45.0 | 44.97 | −10 |
| Eutelsat 2F4 | 318.2 | 46.4 | 43.57 | −7 |
| Eutelsat 2F2 | 322.2 | 48.2 | 41.76 | −4 |
| Eutelsat 2F1 | 326.7 | 49.9 | 40.05 | 0 |
| Eutelsat 2F3 | 331.5 | 51.5 | 38.54 | 4 |
| ASTRA | 337.1 | 52.8 | 37.17 | 7 |
| DFS - 3 | 345.0 | 54.2 | 35.78 | 10 |
| DFS - 2 | 355.0 | 55.1 | 34.90 | 12 |
| Intelsat 604 | 48.1 | 43.0 | 47.01 | −14 |
| Intelsat 602 | 51.2 | 40.9 | 49.07 | −17 |

RESIDUAL TRACKING ERROR RE-CAP:
AVERAGE ERROR = .00170 DEGREES
MAXIMUM ERROR = .01064 DEGREES<<
<<CONTROLLING ERROR MINIMIZATION

TABLE G

Longitude: 119.8 WEST Latitude: 39.5 NORTH
Compass Error: 16 ¼ EAST
Around: RENO. NEVADA AXIS = 40.20 ZENITH = 45.71

| SATELLITE DESIGNATN | FREQ BAND | TRUE AZMTH | ELEV ANGL | EXTRM SLOPE | ERROR D/10K |
|---|---|---|---|---|---|
| AURORA 2 | C: | 208.7 | 40.1 | 49.86 | −2 |
| SATCOM C1 | C: | 206.0 | 40.9 | 49.07 | −1 |
| SATCOM C4 | C: | 203.3 | 41.6 | 48.39 | 1 |
| GALAXY 1 | C: | 200.2 | 42.3 | 47.72 | 2 |
| SATCOM C3 | C: | 197.3 | 42.8 | 47.17 | 4 |
| ASC 1 | C&K: | 192.8 | 43.5 | 46.50 | 5 |
| GLX5 + GSt2 | C&K: | 188.1 | 44.0 | 46.03 | 7 |
| TEL3 + SBS5 | C&K: | 185.0 | 44.2 | 45.83 | 7 |
| MORELOS 2 | C&K: | 175.3 | 44.2 | 45.82 | 7 |
| ANIK C3 | K: | 172.3 | 44.0 | I/O's Center | |
| ANIK E1 | C&K: | 166.5 | 43.4 | 46.60 | 5 |
| MORELOS 1 | C&K: | 163.6 | 43.0 | 47.02 | 3 |

TABLE G-continued

Longitude: 119.8 WEST Latitude: 39.5 NORTH
Compass Error: 16 ¼ EAST
Around: RENO. NEVADA AXIS = 40.20 ZENITH = 45.71

| SATELLITE DESIGNATN | FREQ BAND | TRUE AZMTH | ELEV ANGL | EXTRM SLOPE | ERROR D/10K |
|---|---|---|---|---|---|
| ANIK E2 | C&K: | 160.8 | 42.5 | 47.52 | 3 |
| G-STAR 4 | K: | 157.4 | 41.8 | 48.22 | 2 |
| G-Star 1 | K: | 154.6 | 41.1 | 48.92 | −1 |
| SPACENET4 | C&K: | 151.8 | 40.3 | 49.69 | −1 |
| DirecTV | K: | 151.8 | 40.3 | 49.69 | −1 |
| GALAXY 4 | C&K: | 149.2 | 39.5 | 50.53 | −3 |
| TEL'R 401 | C&K: | 146.5 | 38.6 | 51.44 | −4 |
| SBS 6 | K: | 144.0 | 37.6 | 52.41 | −5 |
| GALAXY 3 | C: | 142.2 | 36.8 | 53.18 | −7 |
| G-STAR 3 | K: | 141.5 | 36.6 | I/O's Center | |
| GALAXY 7 | C&K: | 139.2 | 35.5 | 54.52 | −8 |
| SPACENET3 | C&K: | 134.6 | 33.2 | 56.83 | −9 |
| TEL2 + K1 | C&K: | 132.5 | 32.0 | 58.05 | −8 |
| SATCOM K2 | K: | 128.3 | 29.4 | 60.60 | −8 |
| SBS 4 | K: | 124.5 | 26.7 | 63,27 | −4 |
| GLX6 + SBS2 | C&K: | 121.7 | 24.7 | 65.35 | 0 |
| SATCOM 2 | C: | 120.0 | 23.2 | 66.76 | 4 |
| SPACENET2 | C&K: | 117.4 | 21.1 | 68.92 | 12 |

'I/O' means Inclined (Unstable) Orbit
These Birds are not shown on Sat Sites.
RESIDUAL TRACKING ERROR RE-CAP
<<CONTROLLING ERROR MINIMIZATION
AVERAGE ERROR = .00046 DEGREES
MAXIMUM ERROR = .00121 DEGREES<<

As will be appreciated by one of ordinary skill in the art, there are times throughout the year in which the sun will either be higher than the satellite transmitter (as in summer) or the sun will be lower than the satellite transmitter (as in winter). In this case, an alternative embodiment of the present invention may be used.

In the winter, for example, it is possible that a selected location will provide adequate and unobstructed signal reception, but the site may actually be in the shadows at the specified time and day. Nevertheless, one of ordinary skill in the art will know that the sun is considerably lower on the horizon than the satellite of interest. In this way, using standard trigonometry, a user of the present invention can easily discern how far beyond a particular reference (i.e., a potential obstruction) a shadow actually extends before the selected site becomes obstructed. In other words, if the dish system is in the shadows, but the trigonometric calculations show that if the sun were actually at the same elevation as the satellite, at the specified time and day, that no shadow would then be present at the site, then the site is obstruction free and a proper choice for antenna location. In this way, the present invention compensates for this winter shadow phenomenon.

Referring now to FIGS. 4A–4I, the sun's elevation relative to a satellite elevation is shown for selected times throughout 1995 and for selected locations. These graphs show the sun's coincidence with the azimuth for the satellite and the elevation relationships between the sun and the satellite at those times. The data, while not exhaustive of all possible Earth locations and satellites of interest, does confirm the logical expectations that, where the satellites of interest are to the East of the site, the times of azimuth coincidence will be in the mornings and where the satellites are to the west, the times will be in the afternoons. These figures further illustrate that during the summer the sun's elevation will be higher than the satellites but during the winter, the sun's elevation will be below the satellites. Note also, that the range of variations in time and elevations are more exaggerated for satellites considerably to the East or West of the site. In quantitative terms, the time of the sun's coincidence may vary, over the year, by more than an hour and a half (without allowance for Daylight Savings Time), and it may change at a rate of up to a minute per day, confirming that specific calculations/predictions should be anticipated for daily application of this invention. The sun's angle of elevation, for judgement of shadows for site surveys, at those times, may vary from half the elevation of the satellite, to more than two and a half times the elevation of the satellite; and, marks on dishes to guide alignment will have to allow for a range in sun elevation from at least twenty degrees below, to more than thirty-five degrees above, the satellite.

The present invention may also be used with systems other than dish systems, i.e. any receiving surface for incident radiation e.g., yagiis, flat plates and the like. In this case, these systems do not typically provide a structure that may be used to create or form a shadow for use in aligning an antenna in accordance with the present invention. Accordingly, it is envisioned that any suitable structure can be either temporarily or permanently mounted to such radiation receiving devices to provide the necessary shadow indicia against any arbitrary or selected reference.

The present invention satisfies a long existing need for improvements in methods for optimizing dish placement relative to a satellite transmitter and for subsequent dish alignment which are easy to use, accurate, reliable, versatile, economical and efficient.

It will be apparent from the foregoing that, while particular forms of the invention have been illustrated and described, various modifications can be made without departing from the spirit and scope of the invention. Accordingly, it is not intended that the invention be limited, except as by the appended claims.

I claim:

1. A method of positioning a radio frequency (R.F.) radiation receptor, comprising the steps of:

selecting a proposed site for an R.F. radiation receptor;

determining the time that the sun and a selected R.F. transmission geostationary satellite are in substantially the same direction with respect to the proposed site; and observing at said time how sunlight radiation falls on said proposed site, the presence of sunlight radiation shadows at said proposed site indicating the probable presence of an R.F. radiation obstruction, indicating a substantially poor site location, the absence of sunlight radiation shadows indicating the probable absence of R.F. radiation obstruction, indicating a substantially good site location.

2. A method as set forth in claim 1, and further including the steps of locating an R.F. radiation receptor at the good site location;

providing a sunlight radiation shadow-producing device for said R.F. radiation receptor; and aligning said R.F. radiation receptor relative to the sun at said determined time by adjusting the position of said R.F. radiation receptor relative to a shadow produced by sunlight impinging upon said receptor structure and on said shadow-producing device, whereby said R.F. radiation receptor can be optimally aligned with the satellite, based upon the known direction of the satellite relative to the sun.

3. A method as set forth in claim 2, wherein aligning said R.F. radiation receptor includes directing the shadow produced by said sunlight radiation shadow-producing device onto a reference scale for an R.F. radiation receptor.

4. A method as set forth in claim 3, wherein adjusting the position of said R.F. radiation receptor includes moving said shadow to account for known differences between the direction to said selected R.F. transmission satellite and the direction to the sun.

5. A method as set forth in claim 4, wherein said difference in direction is in azimuth, in elevation, or in both azimuth and elevation.

6. A method as set forth in claim 1, wherein determining the time that the sun and a selected satellite are in substantially the same direction includes determining the azimuthal direction elevational direction, or both azimuthal and elevational directions of the sun and the selected satellite.

* * * * *